US005489898A

United States Patent [19]

Shigekusa et al.

[11] Patent Number: 5,489,898

[45] Date of Patent: Feb. 6, 1996

[54] TASK COMPLETION CONFIRMATION SYSTEM FOR VEHICLES

[75] Inventors: Hisashi Shigekusa, Okazaki; Naoki Tokitsu, Kariva, both of Japan

[73] Assignee: Nippondenso Co., Ltd., Kariya, Japan

[21] Appl. No.: 217,746

[22] Filed: Mar. 25, 1994

[30] Foreign Application Priority Data

Mar. 26, 1993 [JP] Japan ..... 5-068592

[51] Int. Cl.[6] ..... G08G 1/123

[52] U.S. Cl. ..... 340/988; 340/995; 364/444; 364/449

[58] Field of Search ..... 340/988, 989, 340/990, 991, 992, 993, 994, 995, 996, 945; 364/449, 443, 444, 460, 424.01

[56] References Cited

U.S. PATENT DOCUMENTS

| | | | |
|---|---|---|---|
| 3,805,056 | 4/1974 | Birkin | 340/996 |
| 3,845,289 | 10/1974 | French | 340/996 |
| 4,437,085 | 3/1984 | Salant | 340/990 |
| 4,584,603 | 4/1986 | Harrison | 340/988 |
| 4,831,539 | 5/1989 | Hagenbuch | 364/449 |
| 4,994,974 | 2/1991 | Cummings | 364/443 |
| 5,014,206 | 5/1991 | Scribner et al. | 364/449 |
| 5,043,902 | 8/1991 | Yokoyama et al. | 340/995 |
| 5,197,009 | 3/1993 | Hoffman, Jr. et al. | 364/444 |
| 5,243,339 | 9/1993 | Graham et al. | 340/945 |
| 5,243,529 | 9/1993 | Kashiwazaki | 364/449 |
| 5,291,411 | 3/1994 | Bianco | 340/992 |
| 5,347,274 | 9/1994 | Hassett | 364/449 |

FOREIGN PATENT DOCUMENTS

| | | |
|---|---|---|
| 63-288399 | 11/1988 | Japan . |
| 3-280200 | 12/1991 | Japan . |
| 3-292599 | 12/1991 | Japan . |

OTHER PUBLICATIONS

Abstract DE 2754117, Dec. 5, 1977, Becker et al.

*Primary Examiner*—Brent A. Swarthout

*Attorney, Agent, or Firm*—Cushman, Darby & Cushman

[57] ABSTRACT

An object of the present invention is to provide a task completion confirmation system for vehicles which allows crew members to carry out their tasks correctly by automatically displaying the tasks which have been completed. A garbage truck goes to a plurality of garbage collecting areas to collect garbage. When the garbage truck comes near or reaches the garbage collecting area, a communication device is capable of communicating with a response device in a display plate. It writes into a storage circuit data indicating garbage collecting points, progress of task, and the like, based on the communication. Accordingly, the crew members are able to collect garbage at each of the garbage collecting areas, without making any mistakes.

4 Claims, 8 Drawing Sheets

TASK COMPLETION CONFIRMATION SYSTEM FOR VEHICLES

BACKGROUND OF THE INVENTION

1. Field of the Invention

The present invention relates to a task completion confirmation system for various vehicles such as shuttle buses, garbage trucks, and mail trucks which go from place to place to predetermined places to perform predetermined tasks, which system is excellent in confirming the places the vehicles have stopped by or, in other words, the tasks which have been completed thereby.

2. Description of the Related Arts

Hitherto, various vehicles such as shuttle buses, garbage trucks, and mail trucks which go from place to place to predetermined places to perform predetermined tasks have not been equipped with a device which allows automatic confirmation of the places the vehicles have gone to, so that such confirmation depended on memory, judgement, or written notes of crew members.

Accordingly, if a crew member remembered incorrectly or misjudged or forgot to write down the places the vehicle has gone to, the shuttle bus would take the wrong route, and the garbage truck and the mail truck would not stop at a predetermined place for garbage collection, and mail collection, respectively.

SUMMARY OF THE INVENTION

The present invention intends to overcome the above problems by providing a task completion confirmation system for vehicles which helps the crew members to carry out their tasks correctly by informing them the tasks which have been completed.

To these ends, there is provided according to the invention a task completion confirmation system for vehicles which go from place to place to a plurality of places to confirm the tasks which have been completed, thereby allowing crew members to carry out the predetermined tasks at the plurality of places, the device comprising: (1) operating means which may be operated by the crew members to confirm the predetermined tasks, when the vehicle is at any one of the plurality of places, (2) vehicle position recognizing means which recognizes whether or not. the vehicle is at any one of the above-described plurality of places to generate a signal which identifies that particular place; (3) display means, equipped in the vehicle, for displaying the plurality of places; and (4) control means which causes the display means to display, differently, the particular places the vehicle has gone to and has not yet gone to, in accordance with output signals from the vehicle position recognizing means, when the operating means has been operated.

In the present invention having the above-described arrangement, when the vehicle reaches each of the predetermined places, the vehicle position recognizing means generates output signals which indicate that the vehicle has reached the predetermined places. At the predetermined places, the crew member operates the operating means to allow the control means to control the display on the display means, in accordance with the output signals. With this control operation, the display means displays, differently, the predetermined places which the vehicle has gone to and the predetermined places which the vehicle has not yet gone to, so that the tasks completed may be displayed. Accordingly, according to the present invention, crew members are capable of accurately confirming the tasks which have been completed, thereby preventing the crew members from carrying out their tasks at wrong places.

BRIEF DESCRIPTION OF THE DRAWINGS

These and other objects and advantages of this invention will become more apparent and more readily appreciated from the following detailed description of the presently preferred exemplary embodiments of the invention taken in conjunction with the accompanying drawings, of which.

DESCRIPTION OF THE PREFERRED EMBODIMENT

Figure 1:
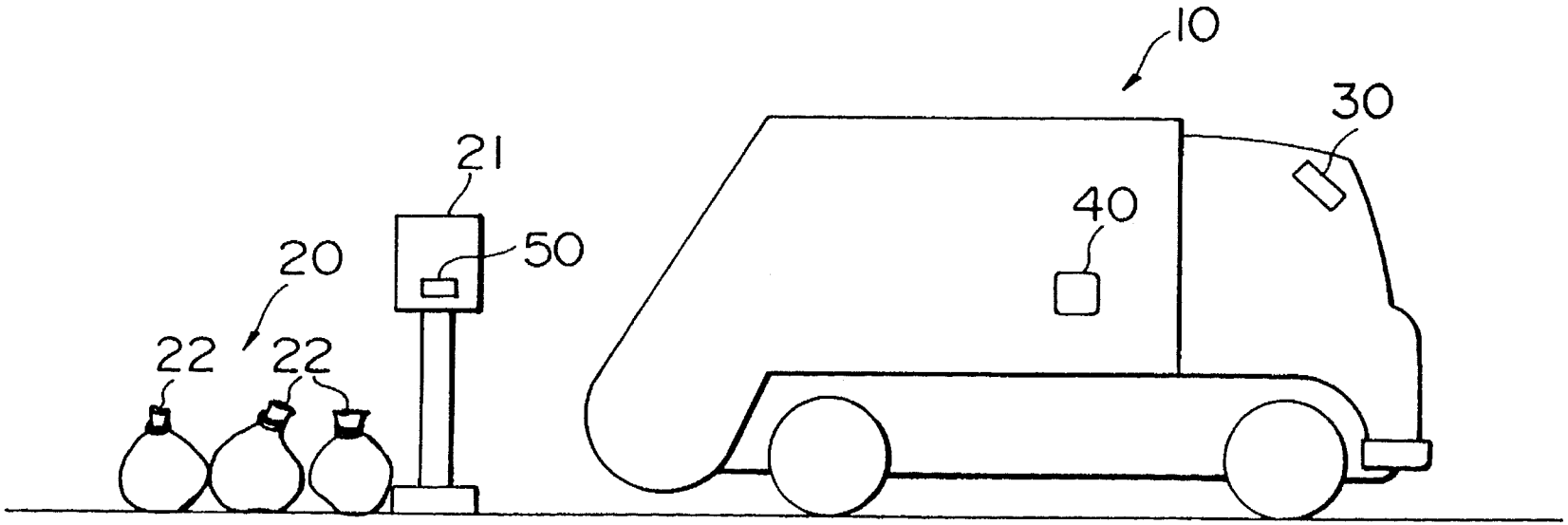
FIG. 1 is a schematic view of a garbage truck corresponding to a first embodiment of the present invention which is at a garbage pickup area.

An embodiment of the present invention will be described in detail below, with reference to the drawings. FIG. 1 roughly illustrates a garbage truck 10, to which is applied a task completion confirmation system for vehicles of the present invention, at one of a predetermined garbage pickup area 20. This system comprises a data processing device located near the driver's seat of the garbage truck 10, a communication device 40 mounted onto a side of the vehicle 10, and a response device 50 incorporated in a display panel 21 which indicates the garbage pickup area 20. A plurality of garbage bags 22 are discarded at each of the garbage pickup areas 20.

Figure 2:
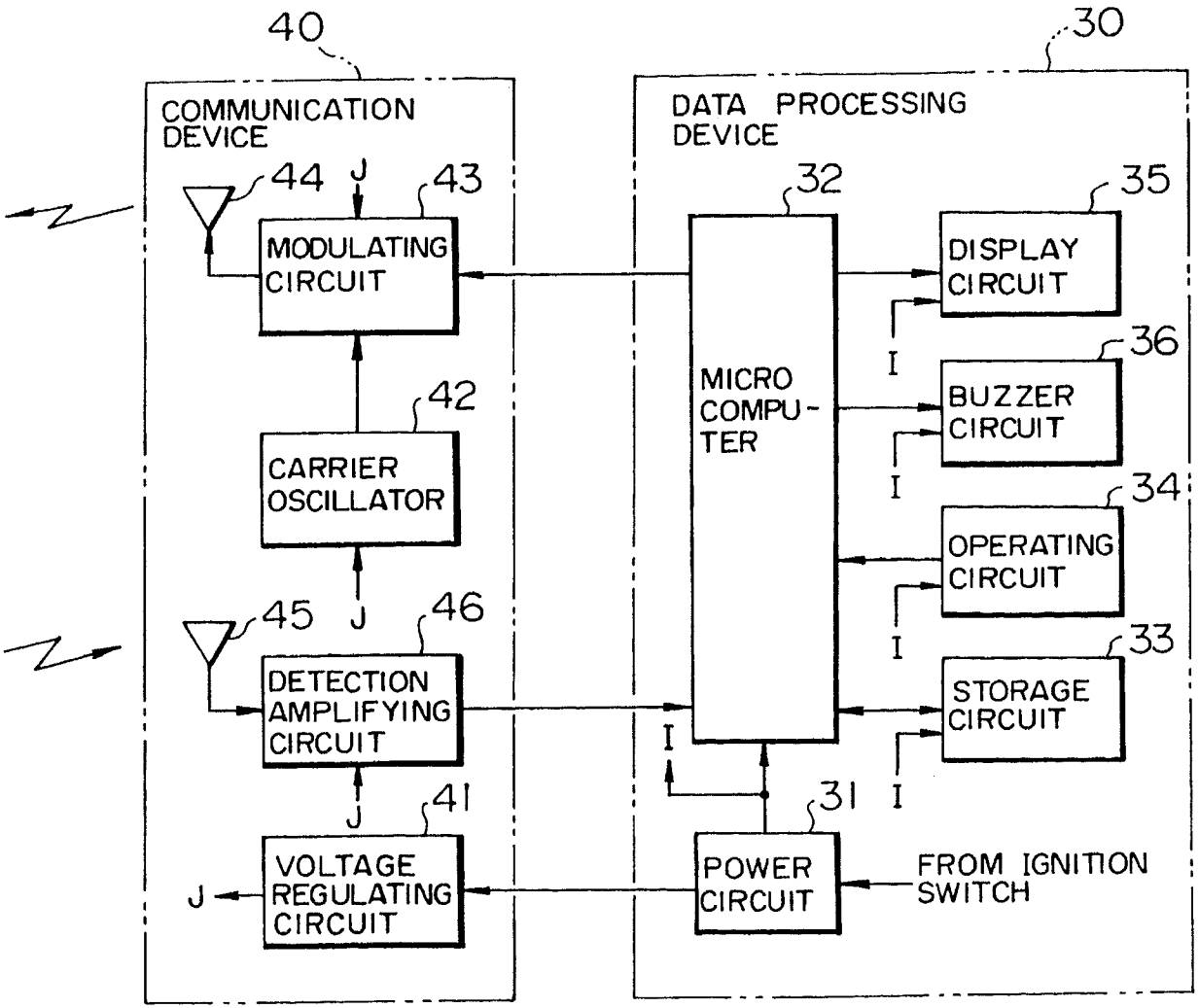
FIG. 2 is a detailed block diagram of a data processing device and a communication device of FIG. 1.

As shown in FIG. 2, data processing device 30 comprises a power circuit 31 which supplies power from a battery (not shown) via an ignition switch. By turning on the ignition switch, the power circuit 31 supplies a predetermined voltage to a microcomputer 32, a storage circuit 33, an operating circuit 34, a display circuit 35, a buzzer circuit 36, and a communication circuit 40. When the voltage is supplied from the power circuit 31, the microcomputer 32 executes a program corresponding to a flow chart shown in FIG. 3 stored in ROM incorporated in the computer 32, thereby allowing it to respond to various signals from the storage circuit 33, the operating circuit 34, and the communication device 40 to control respectively the storage circuit 33, display circuit 35, buzzer circuit 36, and the communication device 40. The storage circuit 33, comprising RAM, non-volatile RAM, and the like, has previously stored data including data representing routes to be taken by vehicle and garbage pickup areas to which the vehicle is predetermined to go. In addition, this storage circuit 33 is such that it stores data which indicates that a predetermined garbage pickup area has been reached, garbage disposal at a predetermined garbage pickup area has been completed, and the like, while the garbage truck 10 is going from place to place. The operating circuit 34 incorporates various operating switches including at least a completion switch. Signals based on the operation of the switch are input into the microcomputer 32. The display circuit 35 displays various data using characters, and the buzzer circuit 36 produces a buzzer sound.

The communication device 40 has a voltage regulating circuit which regulates the voltage output from the power circuit 31 of the data processing device 30. The circuit 41 regulates the voltage generated from the power circuit 31 and outputs the regulated voltage, thereby allowing the carrier oscillator 42, the modulating circuit 43, and the detection amplifying circuit 46 to operate. The modulating circuit 43, which is controlled by the microcomputer 32, outputs to the transmitting antenna 44 carrier signals from the carrier oscillator 42 as it is, without modulating the signals, or outputs to the transmitting antenna 44 carrier signals from the carrier oscillator 42 after modulating them by means of the signals from the computer 32. The transmitting antenna 44 transmits the unmodulated or modulated signals to the response device 50. The detection amplifying circuit 46 detects and amplifies signals transmitted from the response device 50 and received by a receiving antenna 45 and outputs the received signals to the microcomputer 32.

Figure 4:
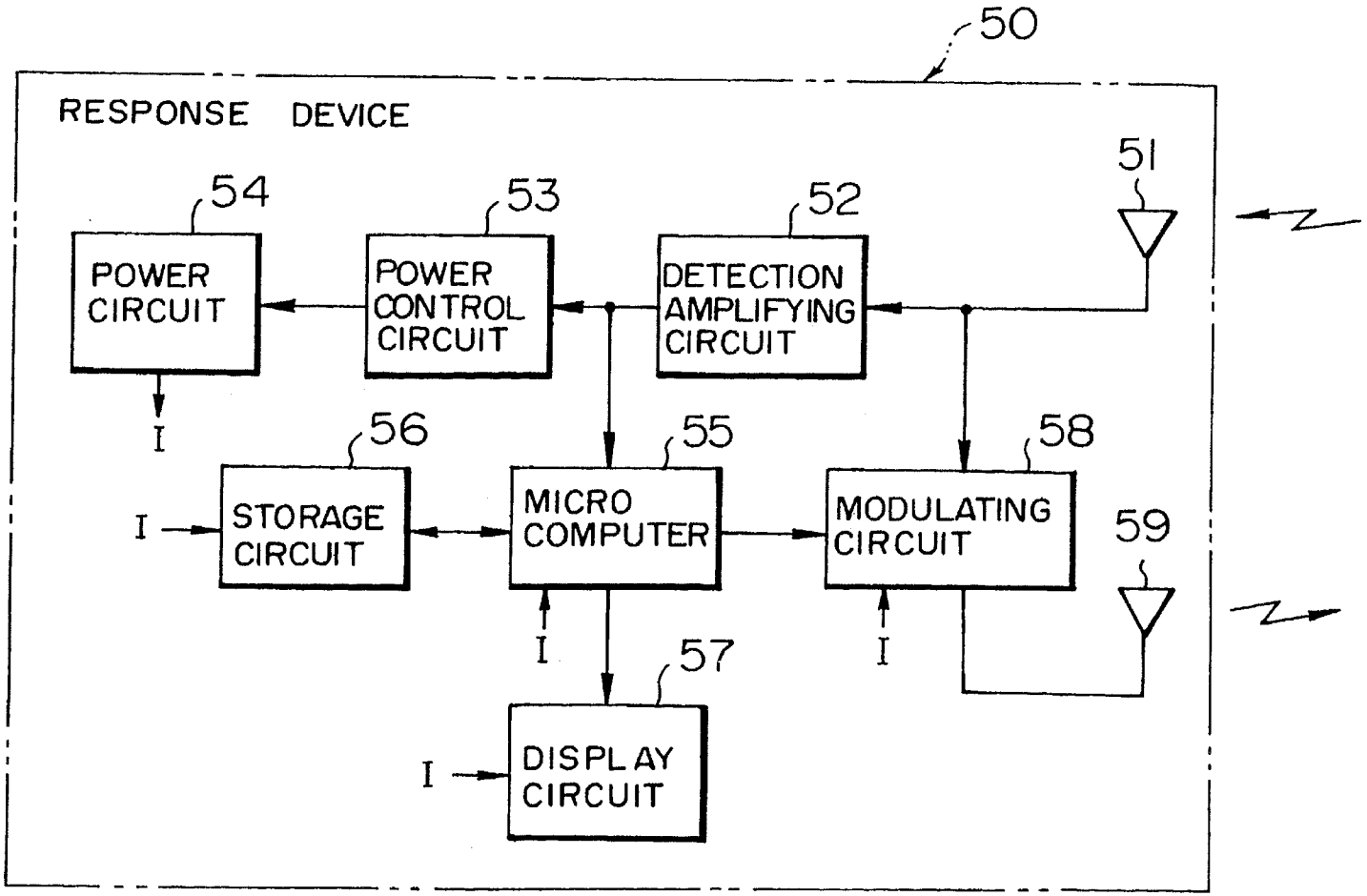
FIG. 4 is a detailed block diagram of a response device of FIG. 1.
Figure 5:
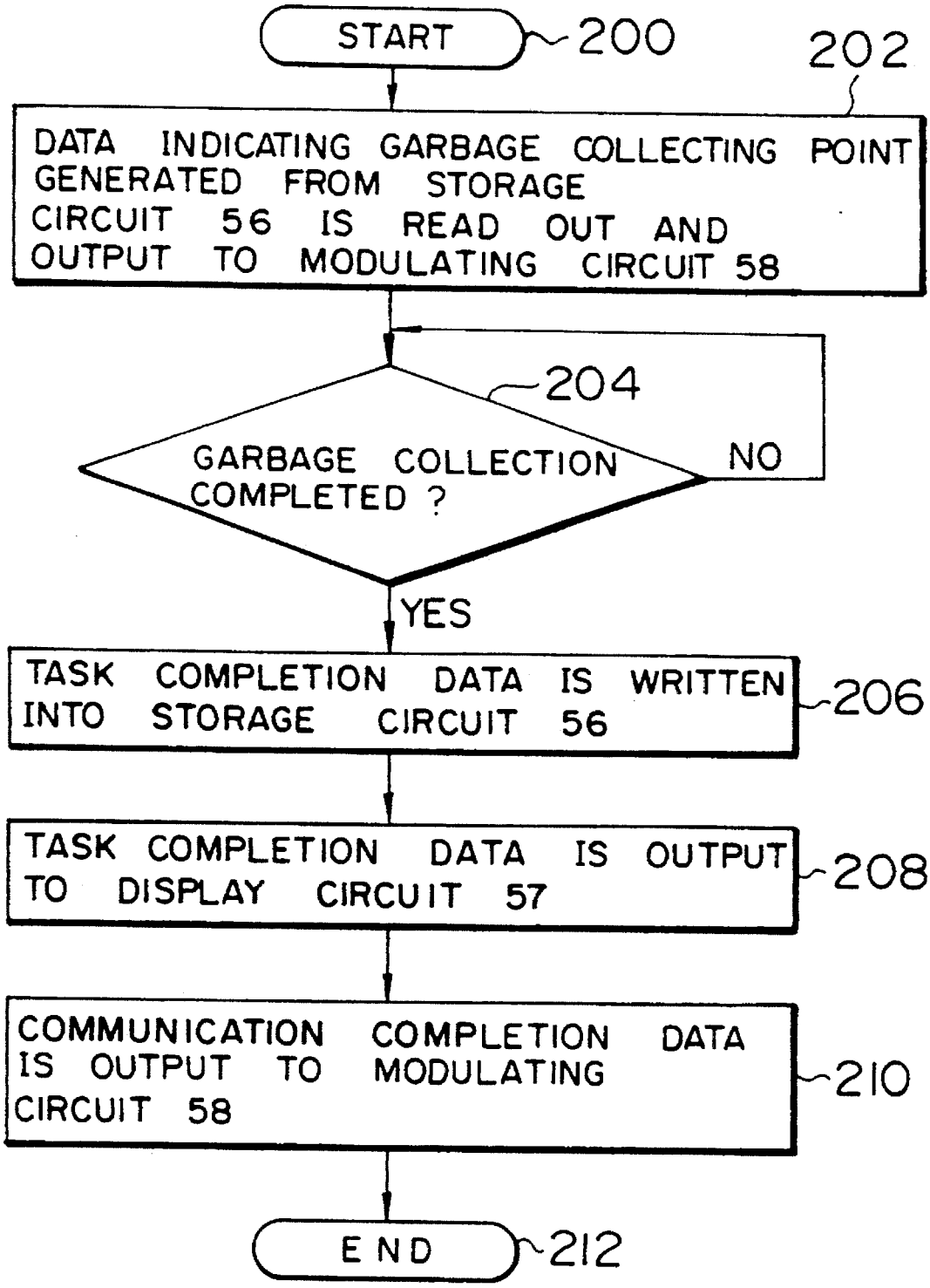
FIG. 5 is a flow chart which corresponds to a program executed by a microcomputer of FIG. 4.

As shown in FIG. 4, the response device 50 comprises a receiving antenna 51, which receives the signals (both the unmodulated and modulated signals) from the transmitting antenna 44 of the communication device 40 and supplies electrical signals which correspond to the received signals to a detection amplifying circuit 52. The detection amplifying circuit 52 detects and amplifies the unmodulated and modulated signals and outputs them to a power control circuit 53 and a microcomputer 55. The power control circuit 53 responds to the unmodulated signals and triggers a power circuit 54. The power circuit 54, which incorporates a battery, responds to this triggering and supplies a predetermined operating voltage to the microcomputer 55, a storage circuit 56, a display circuit 57, and a modulating circuit 58. The microcomputer 55 starts executing a program which corresponds to the flow chart shown in FIG. 5, the program being stored in ROM incorporated in the computer 55 by means of voltage supplied from the power circuit 54. The execution of the program allows the computer to respond to various signals generated from the detection amplifying circuit 52 and the storage circuit 56 to control respectively the storage circuit 56, the display circuit 57, and the modulating circuit 58. The storage circuit 56, which comprises RAM, nonvolatile RAM, and the like, previously stores various data which includes at least data indicating the predetermined garbage pickup area. It also stores data showing that garbage has been collected at this garbage pickup area, while the garbage truck 10 is travelling. The display circuit 57 displays the supplied data using characters and the like. By means of the signals supplied from the microcomputer 54, the modulating circuit 58 modulates the unmodulated carrier signals received from the receiving antenna 51 to supply them to a transmitting antenna 59. The same antenna 59 transmits the supplied signals to the communication device 40.

Figure 6:
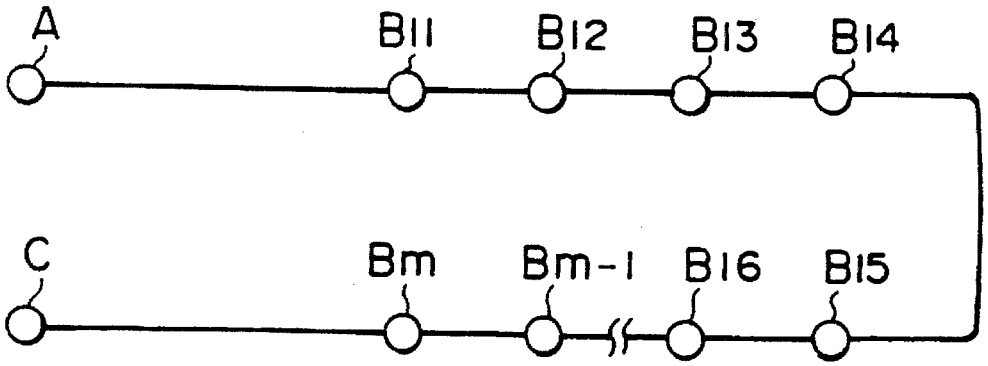
FIG. 6 is a diagram illustrating each of the various places to which the garbage truck goes.

Next, the operation of the embodiment having the above-described arrangement will be described. The garbage truck 10 in FIG. 6 is assumed as starting from starting point A. With the ignition switch turned on to start the truck, the power circuit 31 of the data processing device 30 regulates and outputs voltage from the battery, so that the microcomputer 32, the storage circuit 33, the operating circuit 34, the display circuit 35, and the buzzer circuit 36 are in operating condition. At the same time, the voltage regulating circuit 41 of the communication device 40 causes the carrier oscillator 42, the modulating circuit 43, and the detection amplifying circuit 46 to be in operating condition. With the above-described component parts in operating condition, the microcomputer 32 executes the program starting from Step 100 in FIG. 3, proceeding through Steps 102 to 122, which Steps are repeated, to control the communication of the response device 50, the storage of the storage circuit 33, the display operation of the display circuit 35, and the sounding of the buzzer circuit 36. In the description which follows, there will be taken as an example, the garbage truck 10, which has completed collecting garbage at each of predetermined garbage pickup areas B11 and B12, and heading toward and reaching garbage pickup area 20 at point B13 to carry out garbage collect thereat.

While the garbage truck 10 is heading toward the garbage pickup area 20 at point B13, the microcomputer 32 executes Step 102 to output a non-modulation operation command to the modulating circuit 43. Then, it executes Step 104 to read out data indicating garbage collecting points B11 through Bm stored in the storage circuit 33, data indicating the garbage collecting points B11 and B12 written therein when the truck was at these points B11 and B12, data indicating task completion, and the like, such that the data is output to and displayed on the display circuit 35. Responding to the non-modulation operation command, the modulating circuit 43 outputs to the transmitting antenna 44 the carrier signals from the carrier oscillator 42 as it is, without modulating them. The antenna 44 transmits these unmodulated signals. Based on the supplied display data, the display circuit 35 displays the garbage collecting points B11 through Bm to which the truck is required to go to. In addition, among the displayed garbage collecting points, it displays garbage collecting points B11 and B12, and the next garbage collecting point B13, and the garbage collecting points B14 through Bm to which the truck has not yet gone to (see FIG. 7), each of the points being displayed in a different manner. This allows garbage collectors to confirm that the next garbage collecting point is B13.

After executing the above-described Steps 102 and 104, the microcomputer 32 executes Step 106 to input the signals from the detection amplifying circuit 46 and judges whether or not the transmitting signals from the transmitting antenna 59 of the response device 50 are received. In this case, if the receiving antenna 45 has not yet received the above-described transmitted signals, execution of Step 106 results in a "NO". In other words, the microcomputer judges that communication is not possible and returns the program back to Step 102, so that Steps 102 through 106 as repeated until communication becomes possible.

While Steps 102 through 106 are repeated, when the garbage truck 10 approaches or reaches the garbage collecting point B13, a receiving antenna 51 of the response device 50 receives the unmodulated signals from the transmitting antenna 44 of the communication device 40 to output them to the detection amplifying circuit 52. The circuit 52 detects and amplifies the unmodulated signals and supplies them to the power control circuit 53. The power control circuit 53 responds to the unmodulated signals and triggers the power circuit 54. The circuit 54 supplies a predetermined voltage to the microcomputer 55, the storage circuit 56, the display circuit 57, and the modulating circuit 58, thereby causing each of the circuits to operate. This allows the microcomputer 55 to start the program from Step 200 in FIG. 5. Then, it proceeds to Step 202 to read out from the circuit 56 data indicating the garbage collecting point B13, the data being previously stored in the storage circuit 56. This data is then output to the modulating circuit 58. The modulating circuit 58 utilizes, as carrier signals, unmodulated signals from the communication device 40 input in the receiving antenna 51, and modulates the carrier wave signals using the signals indicating the above-described data to transmit the modulated signals to the communication device 40 via the transmitting antenna 59.

Figure 7:
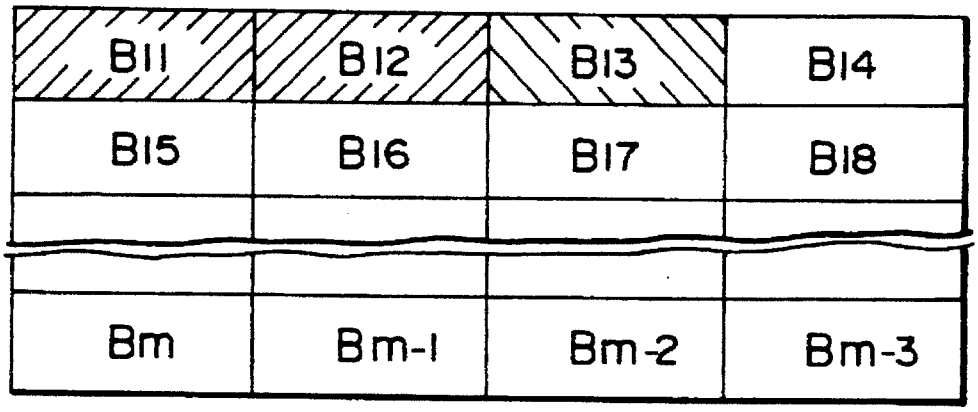
FIG. 7 is a diagram showing an example of a display circuit of FIG. 2.

When the receiving antenna 45 of the communication device 40 receives the signals transmitted from the response device 50, the received signals are supplied to the detection amplifying circuit 46. The circuit 46 detects and amplifies the transmitted signals to supply them to the microcomputer 32. Accordingly, the execution of Step 106 results in a "YES". In other words, the microcomputer 32 judges that communication is possible, and proceeds to Steps 108 through 112 of the program. In Step 108, there is input data indicating garbage collecting point B13 represented by the signals from the detection amplifying circuit 46. In Step 110, the above-described input data is written into the storage circuit 33 and output to the display circuit 35. In Step 112, the buzzer circuit 36 is operated. Accordingly, the display circuit 35 indicates that the garbage truck 10 has reached the garbage collecting point B13 (e.g. as shown in FIG. 7, the way in which the garbage collecting point B13 is displayed is changed by changing its shading, making it blink, and the like). In addition, since the buzzer circuit 36 generates a sound, the garbage collector is capable of confirming with certainty that the garbage truck 10 has reached the garbage pickup area 20 at point B13.

Then, the garbage collector gets off the garbage truck 10 and collects the garbage bags at the garbage pickup area 20 to transfer them into the truck 10. After having completed the task, the garbage collector operates a completion switch in the operating circuit 34. Responding to the operation of the completion switch, the operating circuit 34 outputs. completion signals to the microcomputer 32, so that the execution of Step 114 results in a "YES". In other words, the microcomputer 32 judges that the garbage collection has been completed, so that it proceeds to Step 116 of the program. In Step 116, data which indicates that the garbage collection has been completed in the garbage collecting point B13 is written into the storage circuit 33. Then, this data and modulation operation command are output to the modulating circuit 43, after which non-modulation operation command is output to the same circuit 43. Using the signals which represent the above-described data, the modulating circuit 43 modulates the carrier signals from the carrier wave oscillator 42, and then transmits the modulated signals via the transmitting antenna 44, after which the carrier wave signals are transmitted from the antenna 44 without being modulated. After executing Step 116, the microcomputer 32 executes Step 118 to sound the buzzer circuit 36 for only a short time. The microcomputer 32, then, executes Step 120 to output to the display circuit 35 the data which indicates that the garbage collecting has been completed. The display circuit 35 displays that the garbage collecting has been completed. For example, in FIG. 7, the display of the garbage collecting point B13 of the display circuit 35 is changed, such that it is displayed in the same way as B11 and B12 where garbage has already been collected. Accordingly, all the garbage collectors are capable of recognizing with certainty that garbage collecting has been completed at the garbage pickup area 20.

On the other hand, based on the data indicating the above-described completion of garbage collecting, the receiving antenna 51 of the response device 50 receives the modulated signals. Then, it receives and outputs the unmodulated-signals to the detection modulating circuit 52 and the modulating circuit 58. The detection amplifying circuit 52 detects and supplies the modulated signals to the microcomputer 55. Accordingly, the execution of Step 204 results in a "YES". In other words, the microcomputer 55 judges that the garbage collecting has been completed, and proceeds to Step 206 of the program. In Step 206, based on the modulated signals, that is, the signals indicating that the garbage collecting has been completed, the data representing the completion of the garbage collecting is written into the storage circuit 56. Next, in Step 208, the data indicating the completion of the garbage collecting is output to and displayed on the display circuit 57. Accordingly, the garbage collectors can learn by looking at the display panel 21 that the garbage collecting at the garbage pickup area has already been completed. After executing Step 208, the microcomputer 55 executes Step 210 to output to the modulating circuit 58 the signals which indicate that communication has been completed, and terminates the program by executing Step 212. With the signals indicating the completion of the communication, the modulating circuit 58 modulates the unmodulated signals (carrier signals) to transmit these modulated signals to the communication device 40 via the transmitting antenna 59.

The receiving antenna 45 of the communication device 40 receives the signals indicating the completion of the communication. The detection amplifying circuit 46 detects and amplifies the received signals and supplies the signals indicating the completion of the communication to the microcomputer 32. The microcomputer 32 executes Step 122 to input the data indicating the completion of communication and outputs this data to the display circuit 35. The completion of communication is displayed on the display circuit 35, which can be learned by the garbage collectors. In this way, when the communication is terminated, the microcomputer 32 returns the program back to Step 102 to start executing the steps to be carried out in the next garbage collecting point B14. The garbage collector starts and drives the garbage truck 10 to head toward the next garbage collecting point B14. After completing garbage collection at each of the garbage collecting points B14 through Bm, the garbage truck 10 goes to garbage disposal facility C to transfer thereto the garbage collected in each of the garbage collecting points B11 through Bm.

As described above, in the above-described embodiment, the garbage truck 10 is provided with the communication device 40, and the response device 50 is provided in the display panel 21 set up at each of the garbage collecting areas 20, such that radio communication may be carried out between the communication device 40 and the response device 50. The garbage collecting areas the garbage truck 10 has gone to, how much garbage has been collected in the garbage collecting area 20, and the like, are stored in the storage circuit 33, which information can be communicated to the garbage collectors by means of the display circuit 35 and the buzzer circuit 36. Therefore, the garbage collectors are capable of accurately knowing the garbage collecting areas the garbage truck has gone to and how much garbage has been collected in each of the garbage collecting points. In addition, by reading out the data stored in the storage circuit 33 after reaching the garbage disposal facility, it can be checked whether or not the garbage truck has gone to every garbage collecting area regularly.

Figure 3:
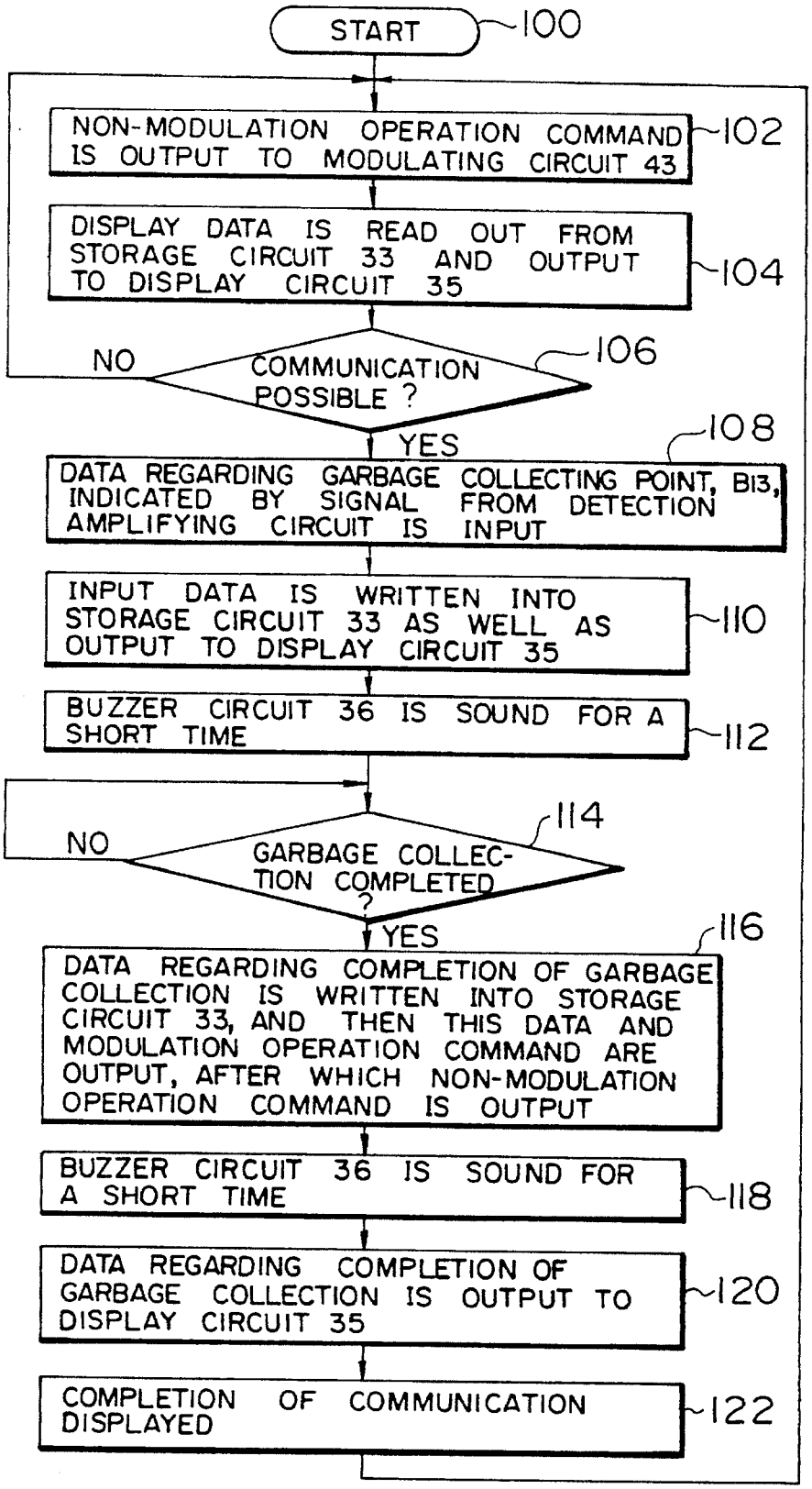
FIG. 3 is a flow chart which corresponds to a program executed by a microcomputer of FIG. 2.
Figure 8:
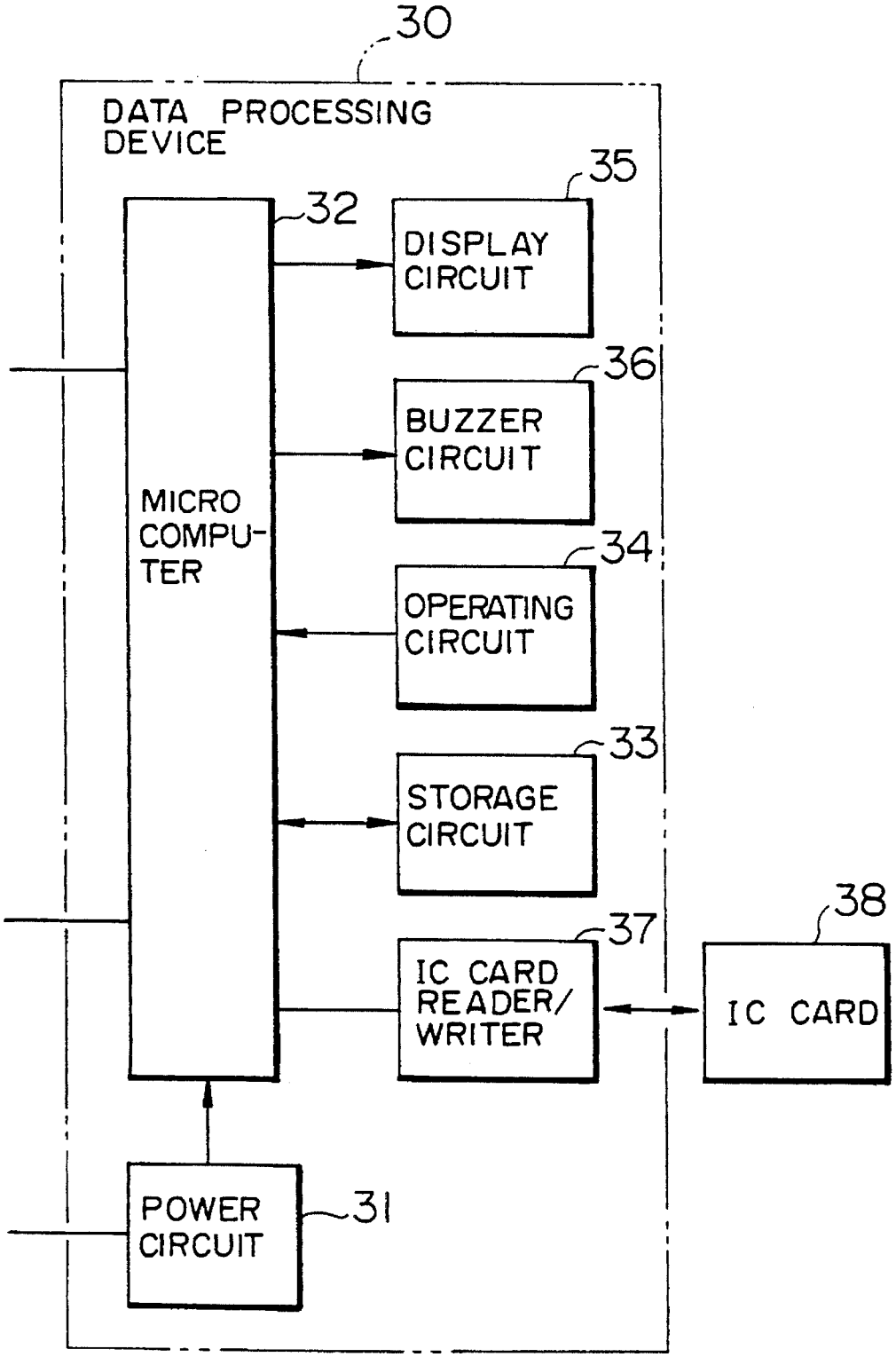
FIG. 8 is a block diagram showing a modification of a data processing device of the aforementioned embodiment.
Figure 9A:
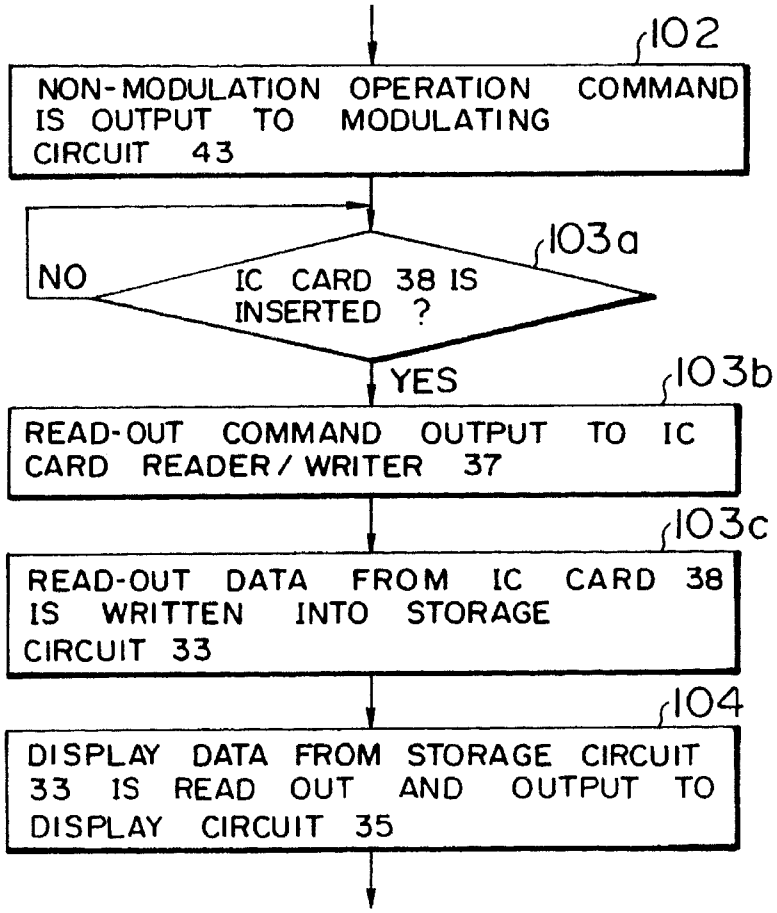
FIG. 9A and FIG. 9B are flow charts, each of which corresponds to a portion of a program executed by a microcomputer of FIG. 8.
Figure 9B:
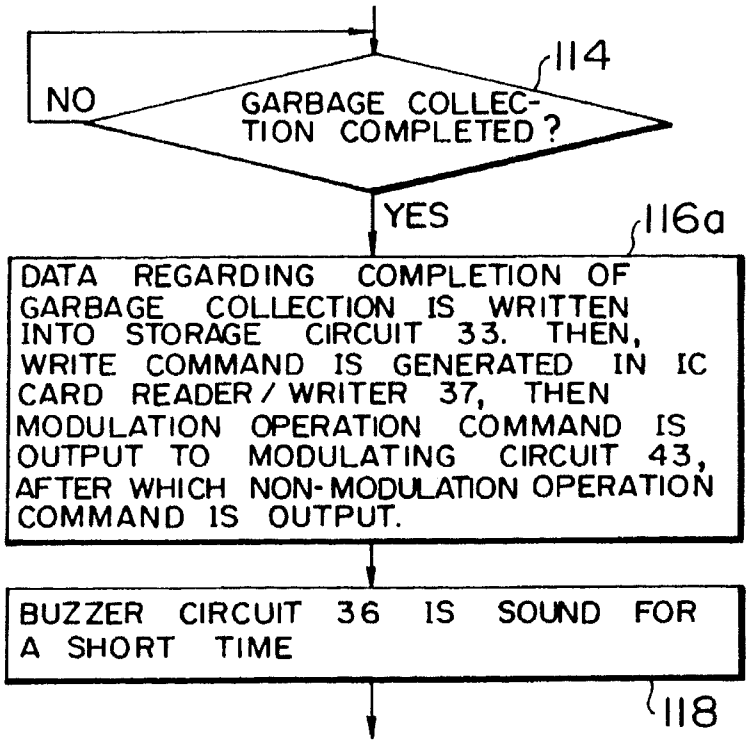

An example of a modification of the data processing device 30 of the above-described embodiment will be described with reference to FIGS. 8, 9A and 9B. The modified data processing device 30 has an IC card reader writer 37 connected to a microcomputer 32 which writes data into and reads out data from an IC card 38. ROM of the microcomputer 32 has previously stored a modified program, shown in the flow charts of FIGS. 9A and 9B, in which a portion of the program of the above-described embodiment, illustrated in FIG. 3, is modified. The other arrangements are the same as those of the above-described embodiment.

In the modification having such an arrangement, after Step 102 of FIG. 3 is completed in the same way as the above-described embodiment, the microcomputer 32 executes Step 103*a*, which results in a "YES", if the IC card 38 is inserted in the card reader writer 37. With Step 103*b*, data is read out by the IC card reader writer 37 to output a command. The IC card reader writer 37 reads out the data indicating the routes the truck is required to take, the garbage collecting areas, and the like, the data being stored in the IC card 38. Then, it outputs the data to the microcomputer 32. After Step 103*b* has been carried out, the microcomputer 32 executes 103*c* to write the read out data into the storage circuit 33, after which the microcomputer 32 proceeds to Step 104 as in the above-described embodiment. In this modification, as illustrated in FIG. 9B, the microcomputer 32 executes Step 116*a* in place of Step 116 of the above-described embodiment to write data indicating the completion of garbage collection into the IC card 38 via the IC card reader writer 37, in addition to outputting this data to the storage circuit 33 and controlling the modulating circuit 43. This allows the routes and garbage collecting points to be changed easily by simply writing data regarding such changes into the IC card 38.

In the embodiment of the present invention, when the garbage truck 10 moves through narrow roads, and the display panel 21 is installed on the left or right side of the road depending on the condition of each of the garbage collecting points, the transmitting antenna 44 and the receiving antenna 45 of the communication device 40 may be respectively installed on the left or right side of the garbage truck 10.

In addition, in the above-described embodiment, operating the completion switch in the operating circuit 34 of the data processing device 30 allows the data indicating the completion of garbage collection to be input to the microcomputer 32. Instead, however, an operating circuit may be provided in each of the response devices 50, so that after the garbage has been collected, the operating circuits of the response devices 50 at each of the garbage collecting points may be operated to allow signals of the operations to be transmitted from the transmitting antenna 59 and to be input to the microcomputer 32 via the communication device 40. There may also be provided a detection switch which detects operations of the garbage truck 10 (e.g. opening and closing of the garbage truck 10 door) during garbage collection. Signals generated by operation of the detection switch may be input to the microcomputer 32.

Further, the above-described embodiment is such that data based on transmitting signals from the communication device 40 are written into the storage circuit 56 of the response device 50. The embodiment, however, may instead be such that predetermined data previously stored in the storage circuit 56 is output to the microcomputer 55, thereby making it unnecessary to write data into the storage circuit 56.

Still further in the embodiment of the present invention, if the data stored in the storage circuit 56 of the response device 50 needs to be changed, new data may be transmitted from the data processing device 30 of the communication device 40 to the response device 50 to change the stored data in the storage circuit 56 of the device 50, while the garbage truck 10 goes around each of the garbage collecting areas.

Further in the embodiment of the present invention, the time when the garbage collection is scheduled to be completed may be also displayed in correspondence with each of the garbage collecting points, which may be communicated to nearby residents.

Further, the present invention is not limited to the garbage truck 10. It may be applied to shuttle buses, mail trucks, and other vehicles which go from place to place to many predetermined places to carry out predetermined tasks.

What is claimed is:

1. A task completion confirmation system for vehicles which go from place to place to a plurality of places to confirm the tasks which have been completed, thereby allowing crew members to carry out predetermined tasks at said plurality of places, said device comprising:

operating means which may be operated by said crew members to confirm said predetermined tasks, when said vehicle is at any one of said plurality of places;

vehicle position recognizing means which recognizes whether said vehicle is at said one of said plurality of places to generate a signal for identifying said one of said plurality of places as a particular place;

display means, equipped in said vehicle, for displaying said plurality of places; and control means which causes said display means to display, differently, the plurality of places said vehicles have gone to and have not yet gone to, in accordance with said signal from said vehicle position recognizing means, when said operating means has been operated, wherein said vehicle position recognizing means comprises:

location point devices installed respectively in said plurality of places;

communication means which communicates by radio with each of said location point devices installed in said plurality of places; and storage means which stores data indicating said plurality of places;

characterized in that based on the communication of said communication means and the stored data of said storage means, said vehicle is recognized to be at said particular place among said plurality of places.

2. A task completion confirmation system for vehicles which go from place to place to a plurality of places to confirm the tasks which have been completed, thereby allowing crew members to carry out predetermined tasks at said plurality of places, said device comprising:

operating means which may be operated by said crew members to confirm said predetermined tasks, when said vehicle is at any one of said plurality of places;

vehicle position recognizing means which recognizes whether said vehicle is at said one of said plurality of places to generate a signal for identifying said one of said plurality of places as a particular place;

display means, equipped in said vehicle, for displaying said plurality of places; and control means which causes said display means to display, differently, the plurality of places said vehicles have gone to and have not yet gone to, in accordance with said signal from said vehicle position recognizing means, when said operating means has been operated, wherein said vehicle position recognition means comprises:

communication means which communicates with said vehicle by radio, installed respectively in each of said plurality of places;

response device which responds to communication from said communication means, installed in said vehicle; and storage means which stores data indicating said plurality of places;

characterized in that based on the response of said response device and the data stored in said storage means, said vehicle is recognized as being at said particular place among said plurality of places.

3. A task completion confirmation system for vehicles according to claim 1, wherein said storage means comprises:

an IC card which stores data indicating said plurality of places; and an IC card reader writer capable of reading out and writing data .stored in said IC card.

4. A task completion confirmation system for vehicles according to claim 1, further comprising arrival recognition means which allows said crew members to recognize that their vehicle has reached the particular place, when said vehicle position recognition means have recognized that said vehicle has reached one of said plurality of places.

* * * * *